United States Patent [19]

Simone et al.

[11] 4,172,024

[45] Oct. 23, 1979

[54] CATALYST WITHDRAWAL AND ADDITION IN A COAL LIQUEFACTION PROCESS

[75] Inventors: Andre A. Simone, Denville; Dennis F. Ogren, Verona, both of N.J.

[73] Assignee: The Lummus Company, Bloomfield, N.J.

[21] Appl. No.: 915,796

[22] Filed: Jun. 15, 1978

[51] Int. Cl.[2] ..... C10G 1/08

[52] U.S. Cl. ..... 208/10; 208/8 LE

[58] Field of Search ..... 208/8, 10

[56] References Cited

U.S. PATENT DOCUMENTS

| | | | |
|---|---|---|---|
| 2,987,465 | 6/1961 | Johanson | 208/10 |
| 3,488,280 | 6/1970 | Schulman | 208/10 |
| 3,700,584 | 10/1972 | Johanson et al. | 208/10 |
| 3,769,198 | 10/1973 | Johanson et al. | 208/10 |
| 3,852,182 | 12/1974 | Sze et al. | 208/10 |
| 3,856,675 | 12/1974 | Sze et al. | 208/10 |

*Primary Examiner*—C. Davis

*Attorney, Agent, or Firm*—Marn & Jangarathis

[57] ABSTRACT

The catalyst is withdrawn from a coal hydroliquefaction reactor while it is maintained on stream by withdrawing a portion of the catalyst, in a separate stream, dispersed in product from the liquefaction zone, with such withdrawn stream being further diluted with liquid recovered from the main product stream to reduce the catalyst concentration. The catalyst containing stream is introduced into the ash separation zone, wherein catalyst is recovered with the ash containing solids. Fresh catalyst is subsequently added to the liquefaction zone in a stream of the liquid recovered from the main product stream.

9 Claims, 1 Drawing Figure

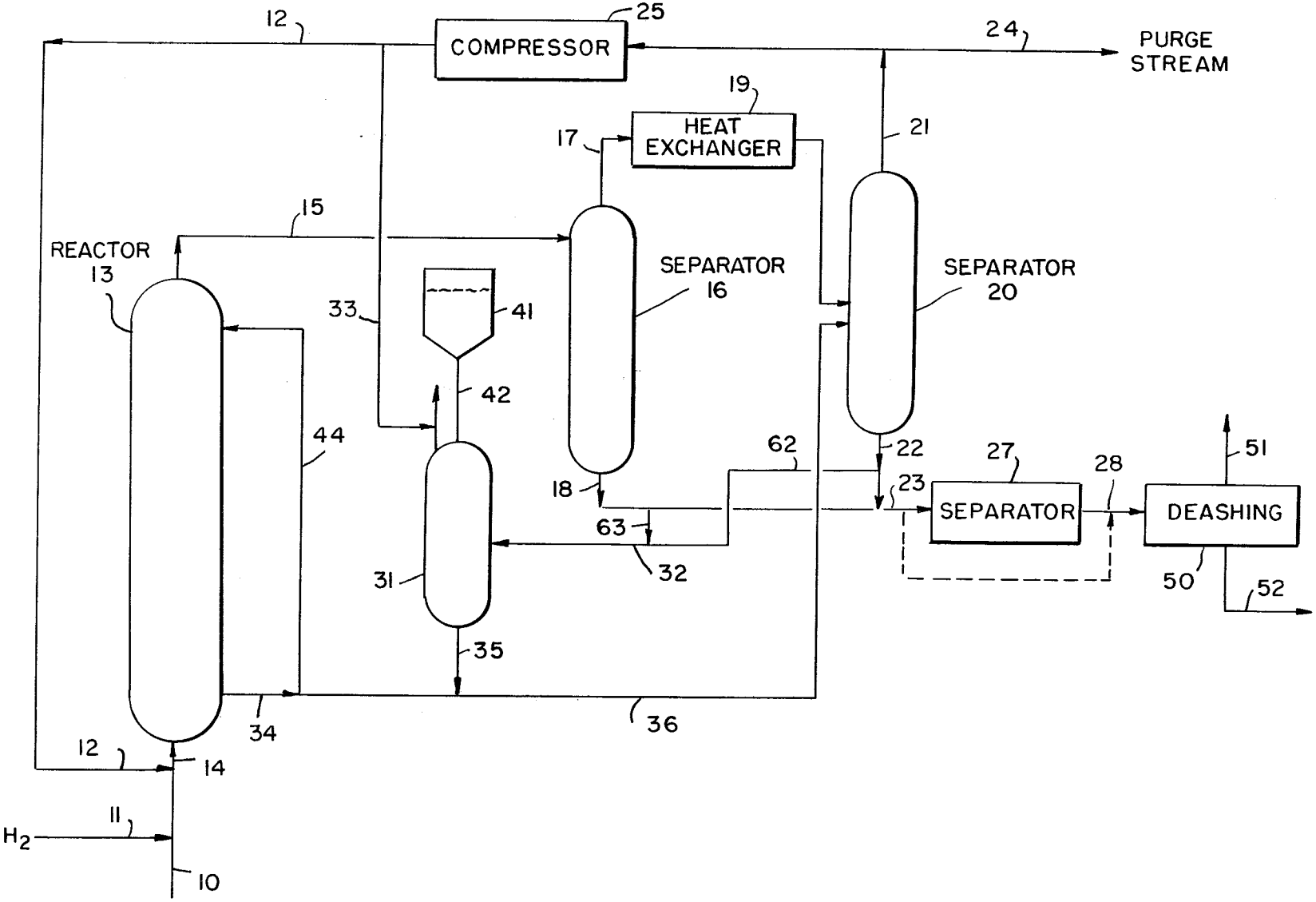
PURGE STREAM
24
25
COMPRESSOR
12
19
HEAT EXCHANGER
17
SEPARATOR 16
18
21
SEPARATOR 20
22
23
27
SEPARATOR
28
DEASHING
50
51
52
62
63
32
36
41
42
35
31
33
15
44
34
REACTOR 13
14
10
11
12
$H_2$

CATALYST WITHDRAWAL AND ADDITION IN A COAL LIQUEFACTION PROCESS

This invention relates to coal hydroliquefaction, and more particularly to the addition and withdrawal of catalyst to and from a coal hydroliquefaction reactor.

In the catalytic hydroliquefaction of coal, the catalyst has a relatively short life due to metallic poisons present in the coal ash. As a result, it is necessary to withdraw poisoned catalyst from the coal hydroliquefaction reactor, and replace such withdrawn catalyst with fresh catalyst.

In accordance with the present invention, coal is hydroliquified in a catalytic hydroliquefaction zone, with liquid product being subsequently introduced into a deashing zone to separate ash containing solids. Periodically, a portion of the catalyst is withdrawn from the catalytic hydroliquefaction zone as a separate stream dispersed in product, while simultaneously withdrawing the main product stream from the catalytic hydroliquefaction zone. The separate stream is combined with a liquid portion recovered from the main product stream to provide a combined stream having a reduced catalyst concentration. The liquid containing withdrawn catalyst is subsequently introduced into the deashing zone wherein the catalyst is separated with the ash containing solids.

After completing withdrawal of the catalyst, fresh catalyst is added to the catalytic hydroliquefaction zone in a stream of liquid recovered from the main product, which is pressurized into such zone.

The present invention will be further described with respect to an embodiment thereof illustrated in the accompanying drawing, wherein:

The drawing is a simplified schematic flow diagram of an embodiment of the present invention.

It is to be understood that processing equipment such as valves, pumps, controls and the like have not been included in the drawing; however, the use of such equipment is deemed to be well within the scope of those skilled in the art.

Referring to the drawing, the coal slurried in a suitable liquefaction solvent in line 10 is combined with fresh hydrogen feed in line 11 and recycle hydrogen in line 12, with the combined stream being introduced into a catalytic hydroliquefaction reactor 13 through line 14.

The coal, which had been previously ground or pulverized, is generally bituminous, sub-bituminous or lignite, preferably bituminous coal of high volatility. The coal liquefaction solvent may be any one of a wide variety of coal liquefaction solvents used in the art, including both hydrogen donor solvents, non-hydrogen donor solvents and mixtures thereof. These solvents are well known in the art and, accordingly, no detailed description thereof is deemed necessary for a full understanding of the invention. A preferred solvent is a coal liquefaction solvent which is a 600° F. to 900° F. liquid recovered from the coal liquefaction product, and which has not been subjected to hydrogenation subsequent to the recovery thereof. The solvent is present in an amount sufficient to effect the desired liquefaction, and in general, is added in an amount to provide a solvent to coal weight ratio from about 1:1 to about 20:1, and preferably from about 1.5:1 to about 5:1.

The coal liquefaction reactor 13 is preferably an ebullating bed reactor, as described in U.S. Pat. No. 2,987,465 to Johannson.

The reactor 13 contains a suitable coal hydroliquefaction catalyst, and the selection of a suitable catalyst is deemed to be well within the scope of those skilled in the art. As representative examples of suitable catalysts, there may be mentioned: cobalt-molybdate, nickel-molybdate, tungsten nickel sulfide, tungsten sulfide, etc., generally supported on alumina or silica-alumina.

The catalytic hydroliquefaction reactor 13 is operated at conditions which are generally known in the art. In general, such conditions are: a temperature of from about 650° to about 900° F., preferably from 750° to 850° F.; an operating pressure of from about 500 psig to about 4000 psig; a hydrogen partial pressure of from about 500 to 3000 psig; and a liquid hourly space velocity from about 0.5 to 4.0 $hour^{-1}$. The above conditions are only illustrative and the selection of optimum conditions is deemed to be within the scope of those skilled in the art from the teachings herein.

A main liquid product stream, containing gas and liquid, is withdrawn from reactor 13 through line 15 and further treated to effect cooling thereof and separate liquid and gas. As hereinafter described, such separation is effected by the use of two liquid-gas separators, with intermediate cooling; however, more than two separators could be employed.

The stream in line 15 is introduced into a gas-liquid separator, schematically indicated as 16. The separator 16 is generally operated at a temperature in the order of from about 650° F. to about 850° F., and a pressure of from about 500 psig to about 4000 psig.

A gaseous stream, which contains hydrogen and other light gases, as well as vaporized coal liquid product and liquefaction solvent, is withdrawn from separator 16 through line 17, cooled in exchanger 19 to effect partial condensation thereof and introduced into gas-liquid separator 20, which is generally operated at a temperature of from about 150° F. to about 650° F. and a pressure of from about 500 to 4000 psig.

A gaseous stream, containing hydrogen and other light gases is withdrawn from separator 20 through line 21 and a portion thereof purged through line 24. The remaining portion is compressed in compressor 25 and recycled to the reactor 13 through line 12. As should be apparent, in many cases, it will be necessary to include additional purification means to separate hydrogen from other normally gaseous components.

Liquid, free of solids, is withdrawn from separator 20 through line 22 and a portion of such liquid, as hereinafter described, may be used for effecting catalyst addition and withdrawal. The remaining portion in line 22 is combined with liquid product, including solids, withdrawn from separator 16 and the combined stream in line 23 introduced into a separation zone 27 to remove products boiling below about 600° F. Alternatively, the product may be passed directly to the subsequent deashing step.

Liquid coal liquefaction product, including the coal liquefaction solvent and ash containing solids in line 28 is introduced into a deashing zone, schematically indicated as 50 for separating ash containing solids from the liquid product.

Coal liquefaction product, essentially free of ash containing solids is recovered through line 51 for further processing and/or recovery of components thereof.

A heavy product, including the ash containing solids is withdrawn from deashing zone 50 through line 52.

The deashing in zone 50 may be effected by any one of a wide variety of processes. Such removal of ash containing solids is preferably effected by the use of a promoter liquid for enhancing the separation of such ash containing solids as described in U.S. Pat. No. 3,852,182 and U.S. Pat. No. 3,856,675, which are hereby incorporated by reference. The solid containing liquid stream in line 52 may be further processed, as described in the aforementioned patents.

The embodiment has been described with respect to the components thereof which are conventional in a coal liquefaction process. In accordance with the present invention, the catalyst withdrawal and feed system are integrated with such conventional components in order to effect periodic withdrawal and addition of catalyst from and to the catalytic hydroliquefaction reactor 13.

In accordance with the present invention, the system operates in order to periodically withdraw a portion of the catalyst from reactor 13, with the reactor 13 maintained in operation during such catalyst withdrawal; i.e., a main product stream is withdrawn through line 15 while catalyst is being withdrawn from the reactor.

In accordance with the present invention, there is provided a catalyst transfer drum 31, which is initially filled with liquid recovered from the product produced in reactor 13, with such liquid being advantageously a liquid free of solids. As shown, a portion of the solid free liquid in line 62 is introduced into drum 31 through line 32. The pressure in the drum 31 is controlled by the addition of compressed hydrogen containing recycle gas through line 33. The pressure is maintained at a level to prevent excessive flashing of the bubble point liquid withdrawn from separator 20.

After the desired amount of liquid has been introduced into transfer drum 31, no further liquid is added through line 32. At this time, a catalyst withdrawal line 34 in the bottom of reactor 13 is opened. Catalyst particles, as well as product; i.e., liquid and vapor, present in the reactor are pressured through the line 34, with liquid present in the transfer drum 31 also being pressured out of the drum through line 35 for combination with the catalyst containing stream in line 34. The liquid withdrawn through line 35 dilutes the catalyst slurry stream in line 34 to provide from about 40 to about 10 volume percent of solids in a combined stream in line 36. The line 34 is maintained open for a period of time sufficient to remove only a portion of the catalyst from reactor 13 in that in accordance with the present invention catalyst is renewed in reactor 13 in a series of periodic removal operations over an extended period of time.

The combined stream in line 36 is introduced into separator 20, whereby liquid product present in the stream in line 36, as well as the catalyst therein, is recovered through line 22, with any vapor products being recovered through line 21. Alternatively, the combined stream in line 36 could be introduced into separator 16. As should be apparent, the contaminated catalyst is eventually introduced into the deashing zone 50 along with the ash containing solids, whereby catalyst is recovered with the heavy liquid product. Thus, such solid catalyst products are effectively removed from the system along with the ash containing solids present in the coal liquefaction product.

The lines 34 and 36 are flushed with remaining liquid in the catalyst transfer drum 31 subsequent to the catalyst removal in order to insure that line 36 is maintained free of solids.

After removal of catalyst from reactor 13, fresh catalyst must be added to replace the withdrawn catalyst.

In accordance with the present invention, fresh catalyst is screened into a catalyst bin 41 and then gravity fed through line 42 into catalyst transfer drum 31. After catalyst is locked into the transfer drum 31, the drum 31 is purged of oxygen by use of a suitable nitrogen purge gas. Subsequently, transfer drum 31 is pressurized by the addition of hydrogen containing gas through line 33. After transfer drum 31 is pressurized, liquid product in line 62 is introduced into drum 31 through line 32 to effect dilution of the catalyst therein. In general, liquid product is introduced in an amount to provide a catalyst concentration of from about 40 to about 10 volume percent of catalyst, preferably from about 30 to about 20 volume percent of catalyst.

The pressure in drum 31 is then further increased by introduction of hydrogen containing gas through line 33, with the catalyst slurried in the liquid product being introduced into reactor 13 through lines 35 and 44, while the reactor is maintained on stream. During the initial stages of catalyst addition to the reactor 13, the catalyst concentration in the slurry entering the reactor is high since the catalyst particles are more or less in a settled state in the transfer drum. As the operation progresses, the material leaving the transfer drum 31 becomes essentially 100 percent liquid which serves to flush any catalyst particles that might have remained in the piping.

Numerous modifications and variations of the presently described embodiment are possible within the scope of the present invention. Thus, for example, the liquid stream employed for removal and addition of catalyst may be obtained from another portion of the process; for example, from line 51. As a further and less preferred alternative, the liquid stream employed for removal and/or addition of the catalyst may be obtained from separator 16 through line 63. The important aspect is that the catalyst is removed from the system with the ash. These and other variations of the hereinabove described embodiment are deemed to be well within the scope of those skilled in the art from the teachings herein.

The present invention is considered to be particularly advantageous in that the catalyst withdrawal and addition are effectively integrated with normal downstream processing equipment. In addition, the liquefaction reactor is maintained on-stream during the catalyst withdrawal and addition. Furthermore, while maintaining a catalyst inventory at a stable and steady activity level, the catalyst concentration in the various product streams is controlled to prevent upsets or malfunction in downstream processing equipment. Thus, for example, the system is operated in a manner such that the catalyst concentration in the net liquid product introduced into the deashing unit is from about 5 volume percent to about 0.1 volume percent, and preferably from about 2 volume percent to about 0.1 volume percent. By employing the present invention, the frequency of operation of the catalyst withdrawal and addition system is minimized. Thus, the system is operated in a manner such that it is periodically operated to remove and replenish only a portion of the total catalyst present in the reactor.

These and other advantages should be apparent to those skilled in the art from the teachings herein.

Numerous modifications and variations of the present invention are possible in light of the above teachings and, therefore, within the scope of the appended claims, the invention may be practised otherwise than as particularly described.

We claim:

1. In the hydroliquefaction of coal in a catalytic hydroliquefaction reactor wherein liquid product produced in the hydroliquefaction reactor is introduced into a solid separation zone to separate ash containing solids, an improved process, comprising:

periodically withdrawing from the hydroliquefaction reactor a separate stream, while simultaneously withdrawing a main product stream from said hydroliquefaction reactor, said separate stream including liquid product and a portion of the catalyst from the hydroliquefaction reactor;

combining a portion of the liquid recovered from the main product stream with said separate stream to provide a combined stream having a reduced catalyst concentration; and introducing liquid containing catalyst from the combined stream into the solid separation zone wherein the catalyst is separated with the ash containing solids.

2. The process of claim 1 wherein the combined stream contains from 10 to 40%, by volume, of solids.

3. The process of claim 2 wherein the catalyst is from 0.1 to 5 volume percent of total liquid introduced into the solid separation zone.

4. The process of claim 3 wherein said periodic withdrawing of a separate stream is effected by pressure from the hydroliquefaction reactor.

5. The process of claim 2 wherein the portion of the liquid recovered from the main product stream which is combined with the separate stream is free of solids.

6. The process of claim 1 and further comprising:

after completing said withdrawal, combining fresh catalyst with a portion of the liquid product; and pressurizing said fresh catalyst dispersed in said liquid product into said hydroliquefaction reactor.

7. The process of claim 6 wherein the fresh catalyst and liquid product portion are combined, under pressure, in a catalyst drum.

8. The process of claim 7 wherein the liquid catalyst and liquid product portion are combined to provide from 10 to 40 volume percent of catalyst.

9. The process of claim 7 wherein the liquid product portion combined with fresh catalyst is free of solids.

* * * * *